US006969212B1

(12) United States Patent
Richens et al.

(10) Patent No.: US 6,969,212 B1
(45) Date of Patent: Nov. 29, 2005

(54) SELF-ALIGNING PIVOTABLE DELINEATOR POLE

(76) Inventors: Carolyn M. Richens, R.R. 1, Box 6990, Pittsfield, ME (US) 04967; Stephen E. Richens, R.R. 1, Box 6990, Pittsfield, ME (US) 04967

( * ) Notice: Subject to any disclaimer, the term of this patent is extended or adjusted under 35 U.S.C. 154(b) by 0 days.

(21) Appl. No.: 10/894,835

(22) Filed: Jul. 20, 2004

Related U.S. Application Data

(60) Provisional application No. 60/582,365, filed on Jun. 22, 2004.

(51) Int. Cl.[7] ..... E01F 9/00
(52) U.S. Cl. ..... 404/10
(58) Field of Search ..... 404/10

(56) References Cited

U.S. PATENT DOCUMENTS

| | | | | |
|---|---|---|---|---|
| 925,342 | A * | 6/1909 | Johnson | 482/90 |
| 2,949,324 | A * | 8/1960 | Birge et al. | 403/229 |
| 4,106,879 | A * | 8/1978 | Diedershagen et al. | 404/10 |
| 4,270,873 | A | 6/1981 | Laehy et al. | 404/10 |
| 4,341,488 | A * | 7/1982 | Ryan | 404/10 |
| 4,491,438 | A | 1/1985 | Berutti | 404/10 |
| 4,565,466 | A * | 1/1986 | Daggs et al. | 404/10 |
| 4,588,324 | A | 5/1986 | Goellner | 404/10 |
| 4,636,109 | A * | 1/1987 | Clausen et al. | 404/10 |
| 5,397,197 | A * | 3/1995 | Beavers | 404/10 |
| 6,149,340 | A * | 11/2000 | Pateman | 404/10 |
| 6,267,529 | B1 * | 7/2001 | Mudryk et al. | 404/10 |

* cited by examiner

*Primary Examiner*—Gary S. Hartmann
(74) *Attorney, Agent, or Firm*—Donald J. Ersler

(57) ABSTRACT

A self-aligning pivotable delineator pole preferably includes a first post, a second post, a first retention tube, a second retention tube, a first coupling member, a second coupling member and an extension spring. A first end of the extension spring is retained in the first retention tube. A second end of the extension spring is retained in the second retention tube. One end of the first post is preferably joined to the first retention tube with the first coupling member. The second post is preferably joined to the second retention tube with the second coupling member. The other end of the first post is inserted into the ground or retained in a weighted base. If a person or an object contacts the second post, the second post will pivot relative to the first post and return to its original position, after the contact ceases.

15 Claims, 3 Drawing Sheets

SELF-ALIGNING PIVOTABLE DELINEATOR POLE

CROSS-REFERENCES TO RELATED APPLICATIONS

This is a utility patent application, taking priority from provisional patent application Ser. No. 60/582,365 filed on Jun. 22, 2004.

BACKGROUND OF THE INVENTION

1. Field of the Invention

The present invention relates generally to delineator poles and more specifically to a self-aligning pivotable delineator pole that may be used for delineating boundaries in different applications.

2. Discussion of the Prior Art

The prior art includes many different types of delineator poles. Some uses of delineator poles include slalom gates, hazard markers, parking lot boundaries, signposts and field markers. Stationary and self-aligning delineator poles are commonly used in competition sports, such as equestrian games (skilled horse riding). The object of the equestrian games is to move through a set of delineator poles without contacting them. Normally, a delineator pole struck by a horse or the rider will knock it over; requiring someone to right the delineator pole. Use of a self-aligning delineator pole will not require someone to reset the knocked-over delineator pole. If a top of the self-aligning delineator pole is struck by a horse or a rider, thereof will deflect.

Some self-aligning delineator poles include U.S. Pat. No. 4,270,873 to Laehy et al., which discloses a pivotable delineator post. The Laehy patent includes a delineator pole that pivots when a force is applied thereto and returns to its original position upon release of the force. U.S. Pat. No. 4,491,438 to Berutti discloses a delineator pole, more particularly for skiing race courses, having a pivotable arrangement. U.S. Pat. No. 4,588,324 to Goellner discloses a slalom pole. The Goellner patent includes a pole which is adapted to be supported in the ground and a lower part to be placed in the ground and an upper part extending upwardly above the ground.

Accordingly, there is a clearly felt need in the art for a self-aligning pivotable delineator pole, which may be used for delineating boundaries for equestrian games, slalom gates, hazard markers, parking lot boundaries, signposts, field markers or any other appropriate application.

SUMMARY OF THE INVENTION

The present invention provides a self-aligning pivotable delineator pole that may be used for delineating boundaries in different applications. The self-aligning pivotable delineator pole (delineator pole) preferably includes a first post, a second post, a first retention tube, a second retention tube, a first coupling member, a second coupling member and an extension spring. A first end of the extension spring is retained in the first retention tube with a first fastener and a first quantity of potting resin. A second end of the extension spring is retained in the second retention tube with a second fastener and a second quantity of potting resin. One end of the first post is preferably joined to the first retention tube with the first coupling member. The second post is preferably joined to the second retention tube with the second coupling member. The other end of the first post may be inserted into the ground or retained in a weighted base. In use, a plurality of delineator poles are placed along the edge of a path. If a person or an object contacts the second post, the second post will pivot relative to the first post. After the second post is deflected, the second post will return to its original upright orientation.

Accordingly, it is an object of the present invention to provide a self-aligning pivotable delineator pole, which may be used for delineating boundaries for equestrian games, slalom gates, hazard markers, parking lot boundaries, signposts, field markers or any other appropriate application.

These and additional objects, advantages, features and benefits of the present invention will become apparent from the following specification.

DETAILED DESCRIPTION OF THE PREFERRED EMBODIMENTS

Figure 1:
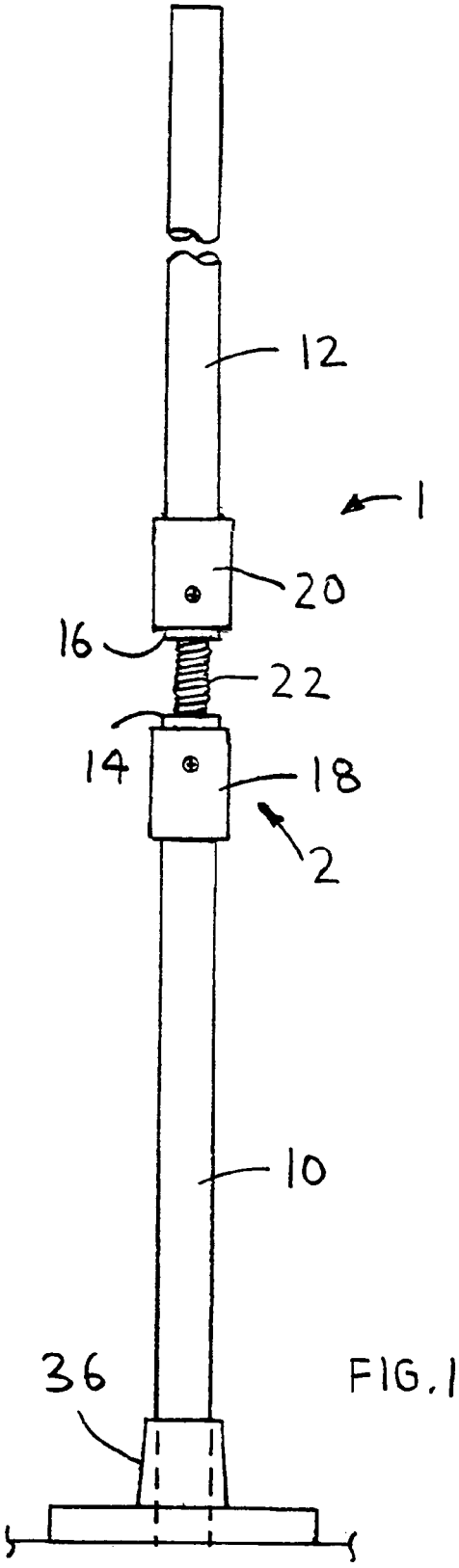
FIG. 1 is a front view of a delineator pole retained in a weighted base in accordance with the present invention.
Figure 2:
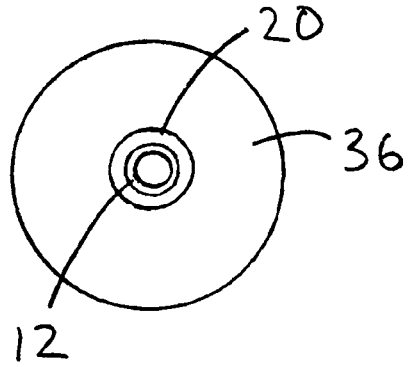
FIG. 2 is a top view of a delineator pole retained in a weighted base in accordance with the present invention.
Figure 3:
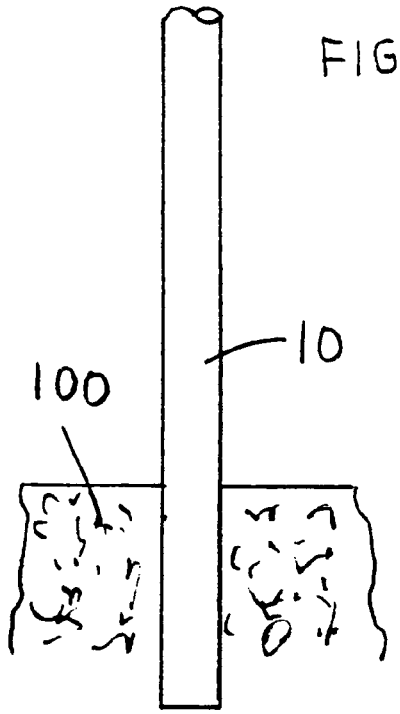
FIG. 3 is a cross sectional view of a delineator pole inserted into the ground in accordance with the present invention.
Figure 4:
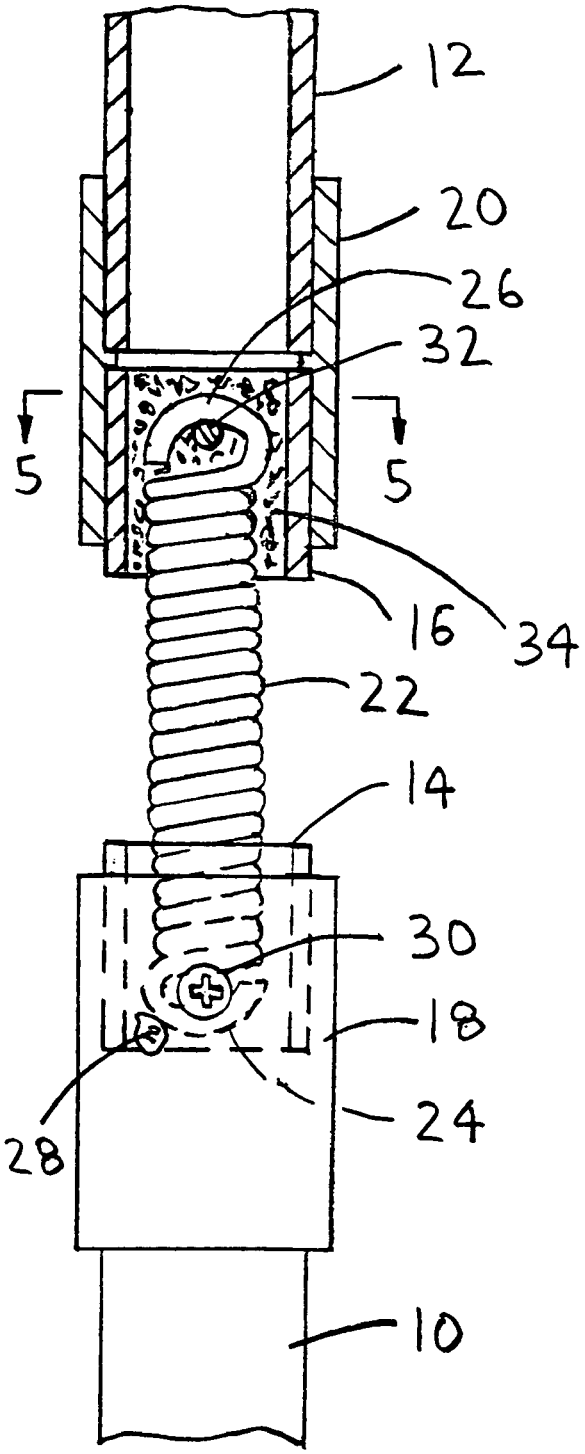
FIG. 4 is an enlarged partial front cross sectional view of an extension spring retained by a first and second retention tube of a delineator pole in accordance with the present invention.
Figure 5:
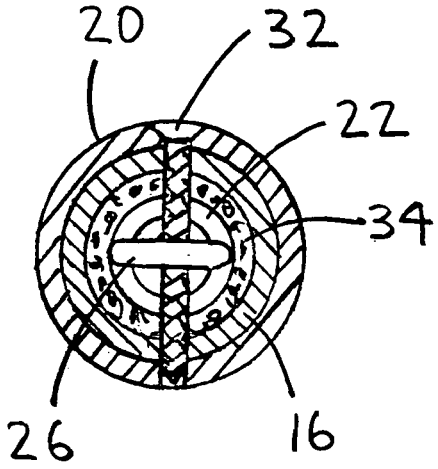
FIG. 5 is an enlarged cross sectional view of an extension spring retained in a first or second retention tube of a delineator pole in accordance with the present invention.

With reference now to the drawings, and particularly to FIG. 1, there is shown a front view of a delineator pole 1. With reference to FIGS. 2–5, the delineator pole 1 preferably includes a first post 10, a second post 12, a first retention tube 14, a second retention tube 16, a first coupling member 18, a second coupling member 20 and an extension spring 22. The first post 10, the second post 12, the first retention tube 14 and the second retention tube 16 are preferably PVC tubing, but other materials may also be used. The extension spring 22 includes a first hook end 24 and a second hook end 26.

The first hook end 24 is retained in the first retention tube 14 with a first fastener 30 and a first quantity of potting resin 28. The first quantity of potting resin 28 prevents the first hook end 24 from shifting within an inner perimeter of the first retention tube 14. The first quantity of potting resin 28 is poured into the inner perimeter of the first retention tube and allowed to harden. The axis of the first retention tube 14 and the axis of the extension spring 22 is preferably substantially parallel. The second hook end 26 is retained in the second retention tube 16 with a second fastener 32 and a second quantity of potting resin 34. The axis of the second retention tube 16 and the axis of the extension spring 22 is preferably substantially parallel. A pin or dowel is to be construed as a fastener. However, there may be an application where the axis of the extension spring 22 is not substantially parallel with the first post 10 and/or the second post 12.

One end of the first post 10 is preferably joined to the first retention tube 14 with the first coupling member 18. The one end of the first post 10 is inserted into a first inner perimeter 19 at one end of the first coupling member 18 and the first retention tube 14 is inserted into the first inner perimeter 19 at the other end of the first coupling member 18. Adhesive is preferably applied to the first inner perimeter 19 of the first coupling member 18 and/or to the outer perimeter of the first post 14. However, other connection methods may also be used, other than the first coupling member 18.

The second post 12 is inserted into an inner perimeter 21 at one end of the second coupling member 20 and the second retention tube 16 is inserted into the inner perimeter 21 at the other end of the second coupling member 20. Adhesive is preferably applied to the inner perimeter 21 of the second coupling member 20 and/or to the outer perimeter of the second retention tube 16. However, other connection methods may also be used, other than the second coupling member 20. The first and second coupling members are preferably PVC couplers, but other materials may also be used. The first and second fasteners are preferably inserted through at least one wall of the first and second coupling members, respectively.

Figure 6:
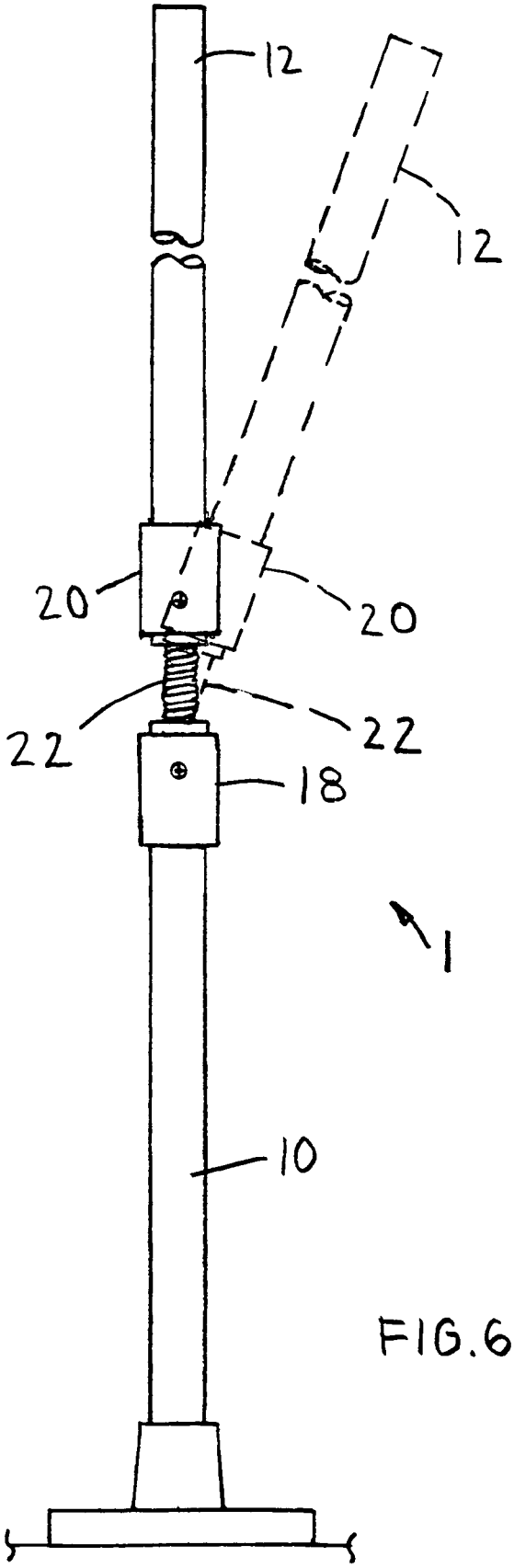
FIG. 6 is a front view of a delineator pole retained in a weighted base with a second post in dashed lines pivoted relative to a first post in accordance with the present invention.

The other end of the first post 10 may be inserted into the ground 100, retained in a weighted base 36 or retained in some other mounting surface. Weighted bases are well known in the art and need not be explained in detail. In use, a plurality of delineator poles 1 are placed along the edge of a path. With reference to FIG. 6, if a person or an object contacts the second post 12, the second post 12 will pivot relative to the first post 10 and the extension spring 22 will stretch. After the second post 12 is deflected, the second post 12 will return to its original upright orientation.

A self-aligning delineator joint 2 includes the extension spring 22, the first hook end 24 retained in the first retention tube 14, the second hook 26 retained in the second retention tube 16, the first coupling member 18 and the second coupling member 20. The first retention tube 14 is retained in the first coupling member 18 and the second retention tube 16 is retained in the second coupling member. A user may purchase the self-aligning delineator joint 2 and cut their own first and second posts to length.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A method of forming a self-aligning pivotable delineator pole, comprising the steps of:

providing an extension spring having a first end and a second end;

retaining said first end in a first retention tube by inserting a first fastener through said first retention tube and said first end, filling said first retention tube with a first potting material such that said first end is in contact with said first potting material;

securing one end of a first post to said first retention tube;

retaining said second end in a second retention tube by inserting a second fastener through said second retention tube and said second end, filling said second retention tube with a second potting material such that said second end is in contact with said second potting material;

securing a second post to said second retention tube; and securing the other end of said first post to a mounting surface.

2. The method of forming a self-aligning pivotable delineator pole of claim 1, further comprising the step of:

securing said first post to said first retention tube with a first coupling member, securing said second post to said second retention tube with a second coupling member.

3. The method of forming a self-aligning pivotable delineator pole of claim 1, further comprising the step of:

securing the other end of said first post to a mounting surface by inserting the other end of said first post into the ground.

4. The method of forming a self-aligning pivotable delineator pole of claim 1, further comprising the step of:

securing the other end of said first post to a mounting surface by retaining the other end of said first post in a weighted base.

5. The method of forming a self-aligning pivotable delineator pole of claim 1, further comprising the step of:

aligning the axis of said first retention tube, said second retention tube and said extension spring substantially parallel with each other.

6. A method of forming a self-aligning pivotable delineator pole, comprising the steps of:

providing an extension spring having a first end and a second end;

retaining said first end in a first retention tube with a first fastener, filling said first retention tube with a first potting material;

securing one end of a first post to said first retention tube;

retaining said second end in a second retention tube with a second fastener, filling said second retention tube with a second potting material;

securing a second post to said second retention tube; and securing the other end of said first post to a mounting surface.

7. The method of forming a self-aligning pivotable delineator pole of claim 6, further comprising the step of:

securing said first post to said first retention tube with a first coupling member, securing said second post to said second retention tube with a second coupling member.

8. The method of forming a self-aligning pivotable delineator pole of claim 6, further comprising the step of:

securing the other end of said first post to a mounting surface by inserting the other end of said first post into the ground.

9. The method of forming a self-aligning pivotable delineator pole of claim 6, further comprising the step of:

securing the other end of said first post to a mounting surface by retaining the other end of said first post in a weighted base.

10. The method of forming a self-aligning pivotable delineator pole of claim 6, further comprising the step of:

aligning the axis of said first retention tube, said second retention tube and said extension spring substantially parallel with each other.

11. A method of forming a self-aligning delineator joint, comprising the steps of:

providing an extension spring having a first end and a second end, said first spring end including a first hook end, said second spring end including a second hook end;

retaining said first hook end in a first retention tube with a first fastener, filling said first retention tube with a first potting material such that said first end is in contact with said first potting material;

securing one end of a first post to said first retention tube;

retaining said second hook end in a second retention tube with a second fastener, filling said second retention tube with a second potting material such that said second end is in contact with said second potting material;

securing a second post to said second retention tube; and securing the other end of said first post to a mounting surface.

12. The method of forming a self-aligning delineator joint of claim 11, further comprising the step of:

securing said first post to said first retention tube with a first coupling member, securing said second post to said second retention tube with a second coupling member.

13. The method of forming a self-aligning delineator joint of claim 11, further comprising the step of:

securing the other end of said first post to a mounting surface by inserting the other end of said first post into the ground.

14. The method of forming a self-aligning delineator joint of claim 11, further comprising the step of:

securing the other end of said first post to a mounting surface by retaining the other end of said first post in a weighted base.

15. The method of forming a self-aligning delineator joint of claim 11, further comprising the step of:

aligning the axis of said first retention tube, said second retention tube and said extension spring substantially parallel with each other.

* * * * *